US006125681A

United States Patent [19]

Orcutt et al.

[11] Patent Number: 6,125,681

[45] Date of Patent: Oct. 3, 2000

[54] PORTABLE CRIMPER

[75] Inventors: Eric D. Orcutt, Rockvale, Tenn.; Christopher B. Andreas, Columbia City, Ind.; Timothy A. Landis, Columbia City, Ind.; Anthony E. Sheckler, Columbia City, Ind.; Murali M. R. Krishna, Ottawa Lake, Mich.

[73] Assignee: Dana Corporation, Toledo, Ohio

[21] Appl. No.: 09/168,695

[22] Filed: Oct. 9, 1998

[51] Int. Cl.[7] ..... B21D 39/04

[52] U.S. Cl. ..... 72/402

[58] Field of Search ..... 72/402, 399; 29/237

[56] References Cited

U.S. PATENT DOCUMENTS

| | | | |
|---|---|---|---|
| 441,882 | 12/1890 | Browning . | |
| 2,311,662 | 2/1943 | Hunziker | 29/237 |
| 2,978,263 | 4/1961 | Walsh et al. . | |
| 3,335,594 | 8/1967 | Peterman et al. . | |
| 3,568,494 | 3/1971 | Geisman . | |
| 3,720,088 | 3/1973 | Pauly et al. . | |
| 3,851,514 | 12/1974 | Chen | 72/402 |
| 3,977,065 | 8/1976 | Johnson | 29/237 |
| 4,014,202 | 3/1977 | VanAllen et al. | 72/402 |
| 4,034,592 | 7/1977 | Chen et al. | 72/402 |
| 4,034,593 | 7/1977 | Patel | 72/402 |
| 4,107,964 | 8/1978 | Smith | 72/402 |
| 4,244,091 | 1/1981 | Kimble et al. | 72/402 |
| 4,309,892 | 1/1982 | Currie | 72/402 |
| 4,773,249 | 9/1988 | Hoff | 72/402 |
| 4,781,055 | 11/1988 | Phipps | 72/402 |
| 4,866,973 | 9/1989 | Hoff | 72/402 |
| 4,885,928 | 12/1989 | Davis et al. | 29/237 |
| 4,886,975 | 12/1989 | Murakami et al. . | |
| 4,887,451 | 12/1989 | Hoff et al. | 72/402 |
| 5,044,190 | 9/1991 | Hoff et al. | 72/402 |
| 5,297,417 | 3/1994 | Orcutt et al. | 72/402 |
| 5,437,177 | 8/1995 | Orcutt et al. | 72/402 |

FOREIGN PATENT DOCUMENTS

1810715 A1 4/1991 U.S.S.R. .

*Primary Examiner*—Daniel C. Crane

*Attorney, Agent, or Firm*—Millen, White, Zelano & Branigan

[57] ABSTRACT

A portable crimping apparatus suitable for crimping hose fittings on high capacity hoses having four to six layers of braided wire reinforcement utilizes a relatively light weight pusher which has openings therethrough to illuminate the crimping operation. The pusher is mounted on a plate attached to a ram of a hydraulic cylinder, which ram is used to advance the pusher. The pusher is retained in position on the plate by thumb operated spring latch. A pair of lifting arms are pivoted to a support for the ram to facilitate carrying the portable crimper apparatus.

14 Claims, 6 Drawing Sheets

PORTABLE CRIMPER

FIELD OF THE INVENTION

This invention relates to devices for crimping fittings onto the ends of hoses, and more particularly to self-contained, portable crimpers.

BACKGROUND OF THE INVENTION

Portable crimpers are well-known devices used to secure cylindrical end portions of fittings onto ends of high pressure hydraulic hoses by crimping. Initially, the inner diameter of the end of the fitting is slightly larger than the outer diameter of the hose allowing the hose to be inserted coaxially into the fitting. In performing the crimping operation, the fitting with the hose therein is inserted within an opening defined by an annular array of crimping dies which are cammed radially inward by the crimper so as to deform the end fitting permanently into the hose.

Generally, these crimpers are comprised of a first frame having at its lower end a base ring with a tapered surface and at its upper end a hydraulic ram. Disposed within the tapered surface of the base are crimping dies arranges in an annular array. The crimping dies are forced radially inward by the tapered surfaced in the base ring when urged downwardly by a pusher driven by a hydraulic ram.

Crimpers, such as the crimper disclosed in U.S. Pat. No. 5,437,177, assigned to the assignee of the present invention, are not suitable for hoses having larger hose capacities, such as 1 ¼" internal diameter hoses having six layers of wire braid reinforcement. Currently, these larger capacity hoses require heavy, cumbersome crimpers which require mounting on a base or stand due to the elevated fluid pressures required for operation. Accordingly, there is a need for a crimper which can couple fittings to higher capacity hoses while remaining portable so as to still provide the conveniences offered by portable crimpers.

SUMMARY OF THE INVENTION

It is the feature of the present invention to provide a new and improved portable crimper which can crimp fittings onto high hydraulic capacity hoses having extra wire braid reinforcement.

In view of this feature and other features, the present invention is directed to an apparatus for crimping a crimping collar of a hose fitting to a hose wherein the apparatus comprises a first frame having an upper end, a lower end and a longitudinal axis; the first frame also having a base ring at the lower end and a hydraulic ram at the upper end. The base ring has an internal camming surface and receives therein an annular crimping die assembly which when pressed axially into the base ring contracts laterally so as to crimp the collar of the hose fitting around the hose. Disposed between the annular crimping die assembly and the hydraulic ram is a pusher which is disposed for axial alignment with the annular crimping die assembly. The pusher has a circular upper end for engagement by the ram and an arcuate lower end with a single gap therein. The lower end has a continuous surface for engaging the crimping die assembly and is joined to the upper end by an arcuate wall in which the gap extends in the axial direction. The arcuate wall has openings therethrough which are circumferentially spaced from one another and are also spaced from the lower end. By so configuring the pusher, the weight of the crimper is substantially reduced, while the crimping area is illuminated with ambient light.

In a further aspect of the invention the pusher has three openings, two of which are proximate the gap and one of which is opposite the gap. In still further aspects of the invention the pusher is made of cast iron and converges from its upper end toward its lower end.

DETAILED DESCRIPTION

Figure 1:
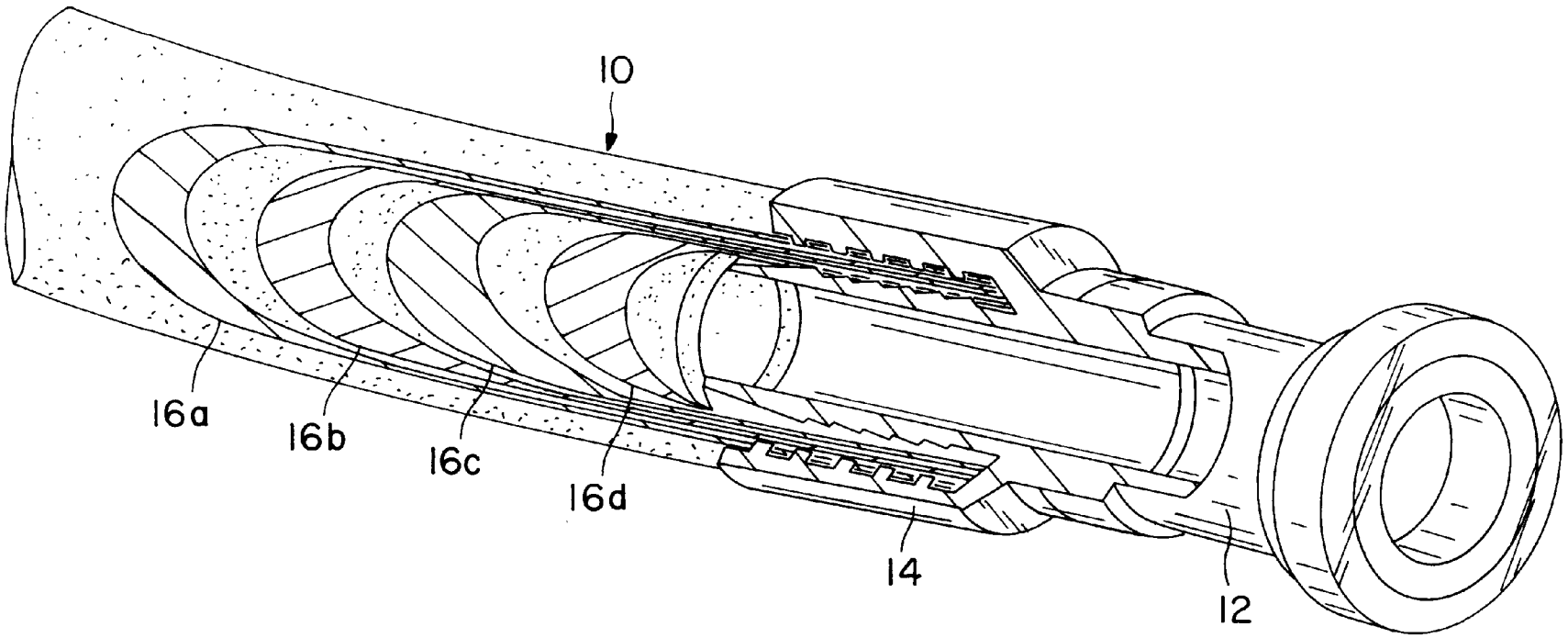
FIG. 1 is a prospective view of high capacity hydraulic hose having extra braided wire reinforcing layers to which a hose fitting is crimped by utilizing the portable crimper apparatus in accordance with the present invention.
Figure 2:
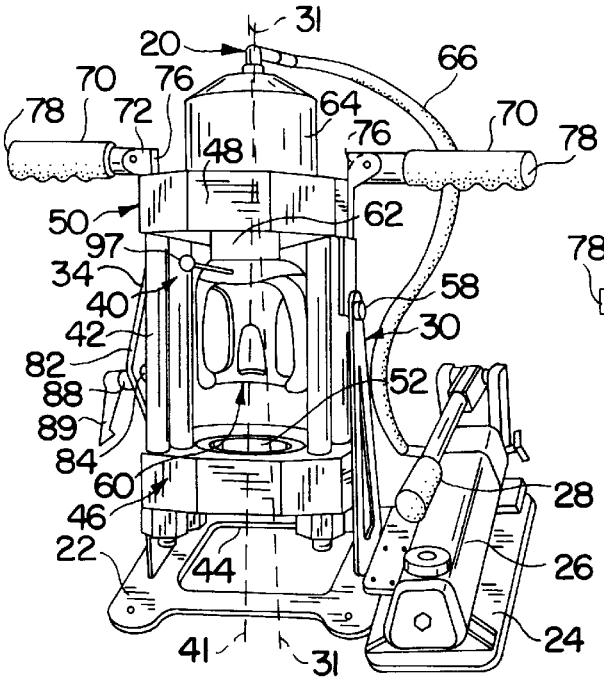
FIG. 2 is a prospective view of a portable crimper apparatus in accordance with the present invention.
Figure 3:
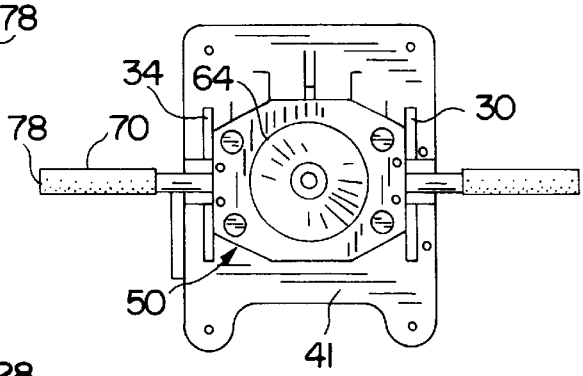
FIG. 3 is a top view of the portable crimper apparatus of FIG. 2 without a hydraulic cylinder attached.
Figure 4:
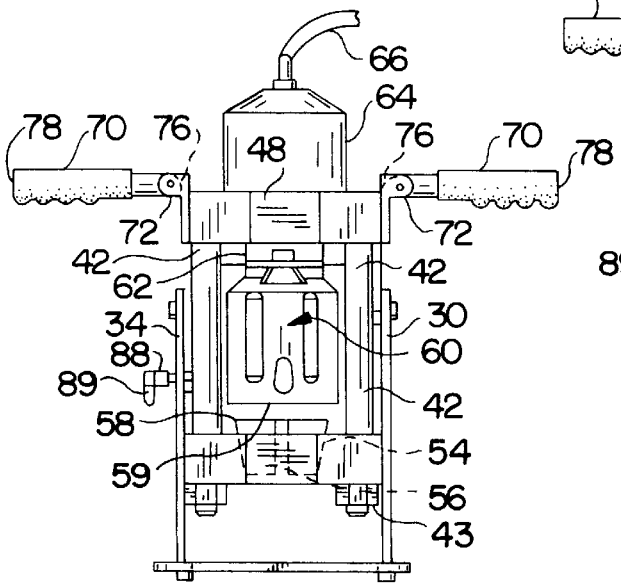
FIG. 4 is a rear view of the portable crimper apparatus of FIGS. 2 and 3.
Figure 5:
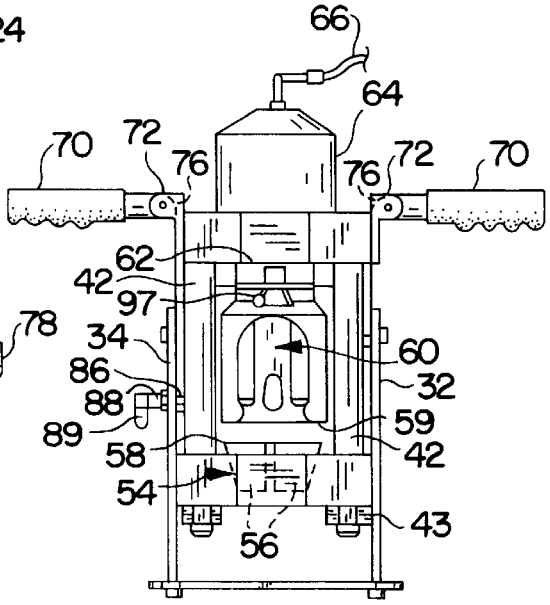
FIG. 5 is a rear view of the portable crimper apparatus of FIGS. 2–4.
Figure 6:
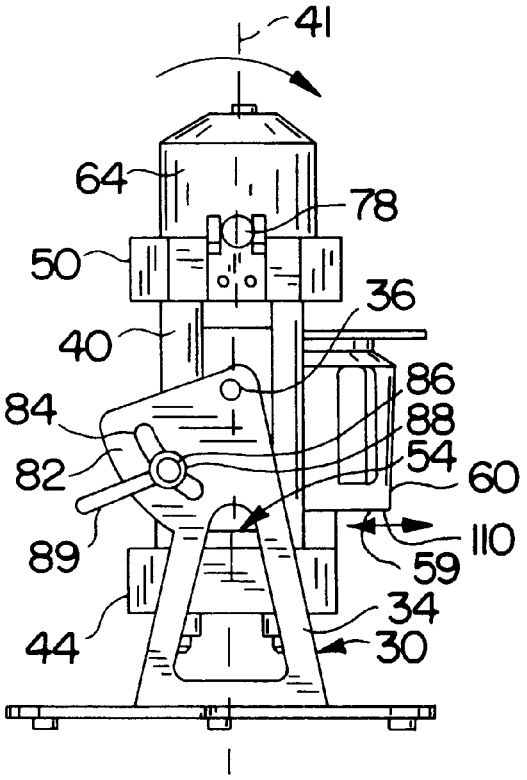
FIG. 6 is a side view of one side of the portable crimper apparatus of FIGS. 2–5.
Figure 7:
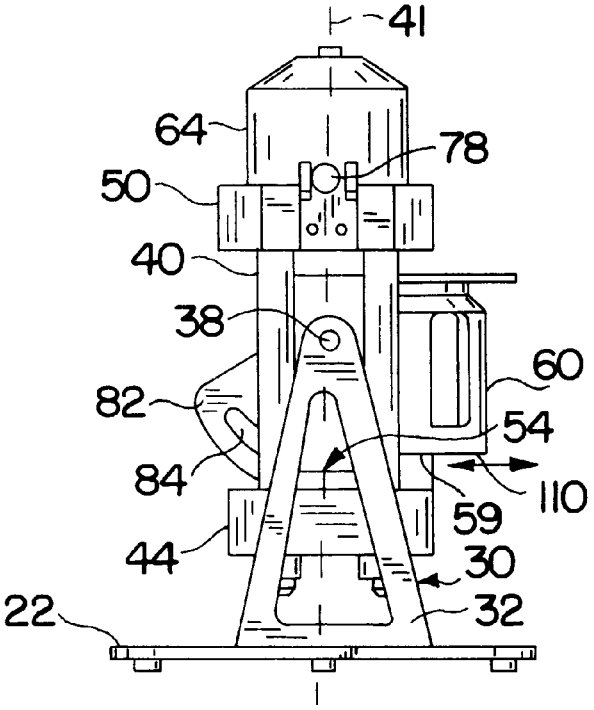
FIG. 7 is a side view of the other side of the portable crimper apparatus of FIGS. 2–6.

Referring now to FIG. 1 there is shown a hose 10 to which a hose fitting 12 is crimped by a crimping collar 14 using a crimper apparatus according to the present invention which is illustrated in FIGS. 2–14. The hose 10 is a high capacity hydraulic hose which in the illustrated embodiment has four layers of wire braid 16*a–b*. While 4 layers 16*a–d* are illustrated, high capacity hoses may have more layers of wire braid reinforcement, for example, six layers. In order to crimp the crimping collars 14 of hose fittings 12 onto high capacity hoses, such as a hose 10 with four or six layers of braided wire reinforcement 16, a portable crimper requires a capacity of sixty tons. In accordance with the present invention, a sixty ton press is accomplished in a crimper apparatus which is portable and of a size and weight not excessively greater than that of the crimper apparatus disclosed in U.S. Pat. No. 5,437,177 and assigned to the assignee of the present invention. The crimper apparatus of the present invention has a weight and size about sixty percent greater than that of the '177 patent while its pressing capacity is twice as large.

Referring now mainly to FIGS. 2–7, a portable crimping apparatus 20 is used to crimp end fittings, such as the end fittings 12, onto hoses, such as the high capacity hose 10 of FIG. 1. The portable crimper apparatus 20 is also capable of crimping hose fittings 12 onto hoses such as 3/16" air hose and, therefore, has a wide range of applications.

The crimper apparatus 20 includes a platform 22 which conveniently rests on a work bench. The platform 22 includes a plate 24 on which a hydraulic cylinder 26 is mounted. In the illustrated embodiment, the hydraulic cylinder 26 is manually pressurized by a pump handle 28, or optionally may be electrically or hydraulically pressurized by electrical or hydraulic units (not shown). A first frame 30 fixed with respect to a vertical axis 31 is comprised a first triangular support 32 and a second triangular support 34 is fixed to the platform 22. Pivoted on pins 36 and 38 to the first frame 30 is a second frame 40 formed about an axis 41. The frame 40 is relatively robust and includes four columns 42 fixed to a base ring 44 at the lower end 46 of the second frame and a ram support 48 at the upper end 50 of the second frame. The base ring 44 has a downwardly tapered frustocounical ram surface 52 therein which receives an annular array 54 of circumferentially spaced dies 56 (see FIGS. 4 and 5). As is well known in the art, when a crimping collar 14 is placed within the annular array 54 of dies 56 and the dies are pressed downwardly within the frustocounical ram surface 52, the dies crimp the crimping collar 14 to secure the hose fitting 12 to the hose 10. Crimping is accomplished by engaging a top surface 58 of the annular array 54 of dies (again see FIGS. 4 and 5) with a bottom surface 59 of a pusher 60. The pusher 60 is advanced by a ram 62 which is moved downwardly upon pressurizing a hydraulic cylinder 64 that is connected by a hose 66 to the hydraulic cylinder 26.

In order to facilitate utilization of the portable crimping apparatus 20, the crimping apparatus is provided with a pair of folding lifting handles 70. The lifting handles 70 are mounted on brackets 72 that are bolted to the ram support 48. When folded, the handles 70 extend in the direction of the axis 41 of the second frame 40. When it is desired to lift the portable crimping apparatus 20, the handles 70 are rotated 90° to the position of FIGS. 2–5 so that rear surfaces 76 engage the brackets 72 to stop rotation of the handle 70. The handle 70 then remain in their horizontal orientation as the portable crimping apparatus 20 is lifted for transport. The handles 70 are provided with hand grips 78 to facilitate lifting.

Since the second frame 40 is pivoted by pivot pins 36 and 38 to the first frame 30, the second frame may be tilted to facilitate the crimping procedure by making it easier to insert the hose 10 into the annular array 54 of crimping dies 56. In order to secure the second frame 40 at an angle where the axis 41 thereof is not vertical, a plate 82 on the triangular support 32 has as an arcuate slot 84 which receives a threaded stud 86 projecting from the second frame 40. A bolt 88 mounted on a handle 89 is threaded onto the stud 86 so that the second frame 40 may be locked at an angle with respect to the first frame 30.

Figure 8:
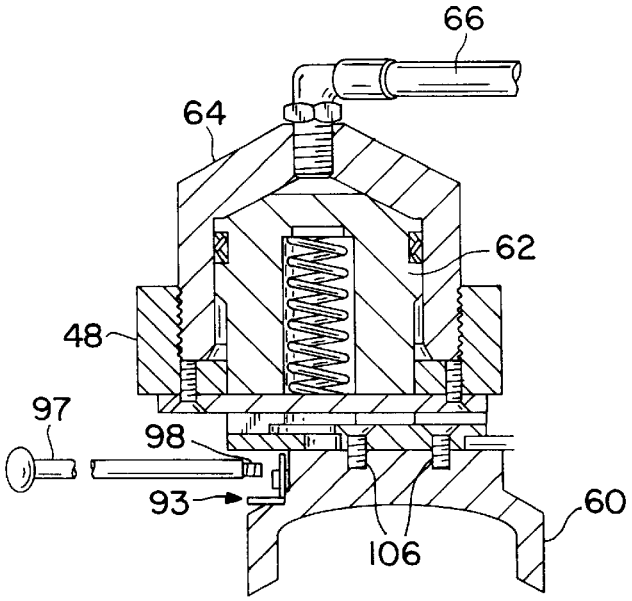
FIG. 8 is a side elevation showing how a pusher of FIGS. 9–13 is mounted on the crimper of FIGS. 2–7.
Figure 9:
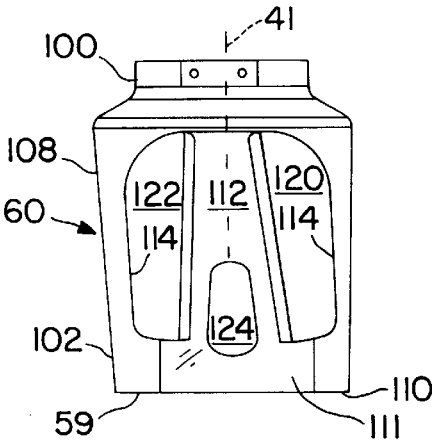
FIG. 9 is a front view of a pusher in accordance with the present invention.
Figure 10:
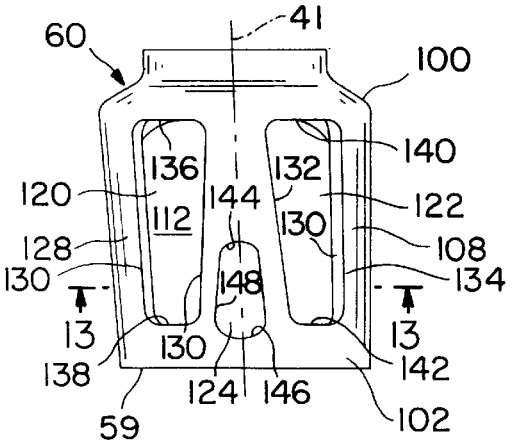
FIG. 10 is a rear view of the pusher of FIG. 9.
Figure 11:
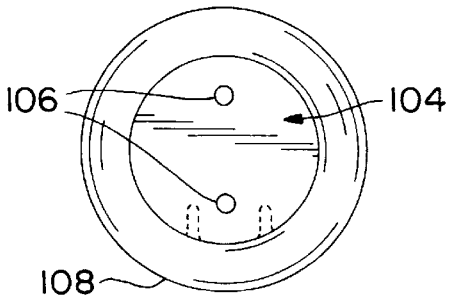
FIG. 11 is a top view of the pusher of FIGS. 9 and 10.
Figure 12:
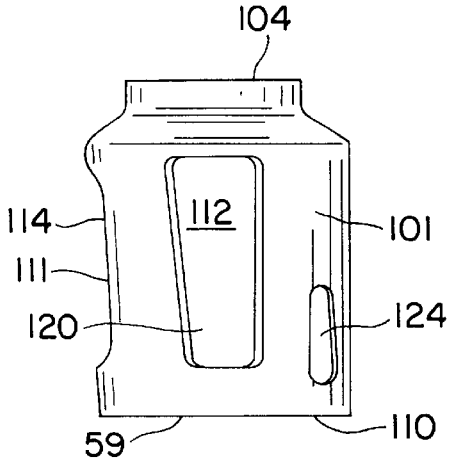
FIG. 12 is a side view of the pusher of FIGS. 9–11.

Referring now to FIG. 8 in conjunction with FIGS. 2–7, in order to facilitate replacing the annular array 54 of dies 56 (FIGS. 4 and 5) and in order to conveniently position the hose 10 and hose fitting 12 within the annular array of dies, the pusher 60 is slid laterally out of alignment with the array of dies and the ram 62. This is accomplished by mounting a slide flange 91 on the pusher 60 in a slot 90 which extends laterally from the axis 41 of the second frame 40 in a slider plate 92 that is fixed to the ram 62. A thumb actuated spring clip 93 holds the pusher 60 in position on the slider plate 92 in alignment with the annular array 54 of dies 56 (FIGS. 4 and 5) so that the pusher urges each of the dies to converge toward the crimping collar 44 evenly.

In order to position the pusher 60, a handle 97 with a threaded end 98 is threaded into the front side of the pusher. When the handle 97 is pulled, it conveniently pulls the pusher 60 to align coaxially with the annular array 54 of dies 56. Alternatively, the handle 96 may be pivoted on the pusher 60.

Referring now mainly to FIGS. 9–13 where the pusher 60 is shown in isolation, the pusher 60 is cast of ductile iron in a single piece and is configured to withstand the force of a sixty ton press while minimizing weight and allowing ambient light to illuminate the crimping area. The pusher 60 has an upper end 100 and a lower end 102. The upper end 100 is closed by a disk portion 104 that has a pair of drilled and tapped holes 106 so that the slider 91 which holds the pusher 60 in the bracket 92 that is fixed to the ram 62 can be secured to the pusher (see FIG. 8). In addition, there are drilled and tapped holes 107 for holding the thumb activated spring clip 93. The upper end 100 the pusher 60 is joined to the bottom end 102 by a downwardly tapering wall 108.

Figure 14:
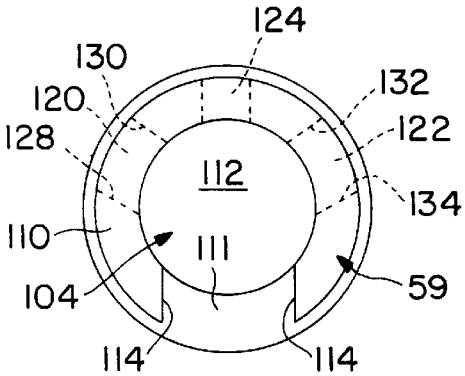
FIG. 14 is a bottom view of the pusher of FIGS. 9–13.

As is seen in FIG. 14, the bottom end of the wall 108 is in the form of an arcuate shoe 110 which has a gap 111 therein which communicates with a hollow space 112. The gap 111 has an arcuate extent of greater than 90° but less than 180°. The gap 111 extends up into the wall to a location proximate the upper end 100 of the pusher 60. The gap 111 has side walls 114 that extend substantially parallel to the radius of the pusher that bisects the gap. The arcuate wall 108 also includes three openings 120, 122 and 124. The openings 120 and 122 are elongated in the direction of the axis 41 and are defined by pairs of substantially straight side walls 128 and 130 and 132 and 134, respectively. Substantially straight side walls 128 and 130 are joined by an upper wall 136 and a lower wall 138 while the substantially straight side walls 132 and 134 are joined by an upper wall 140 and a lower wall 142.

The third opening 124 has a height substantially less than the openings 120 and 122 and is nested therebetween opposite the gap 111. The opening 124 has an arcuate upper wall 144 and an arcuate lower wall 146 which are joined by substantially straight side walls 148. The bottom wall 146 is closer to the lower end 102 of the pusher 60 than the bottom walls 138 and 142 of the openings 120 and 122.

Figure 13:
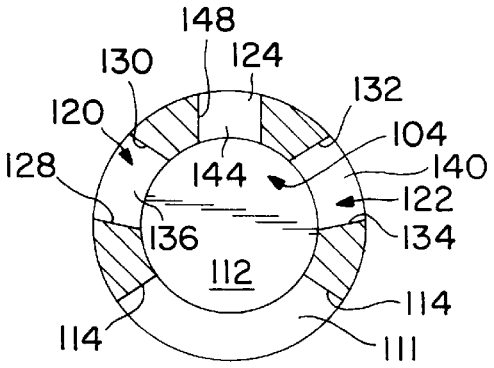
FIG. 13 is an evaluation of the pusher taken along lines 13—13 of FIG. 10.

As is seen in FIGS. 13 and 14, the substantially straight side walls 128, 130, 132, 134 and 138 are substantially parallel to bisecting radii as the walls extend toward the lower end 102 of the pusher 60, while the side walls 114 of the gap 111 tend to converge as the walls extend toward the bisecting radius of the lower end of the pusher.

By so configuring the pusher 60 its weight is minimized while its strength is maintained and the light necessary to illuminate the hose fitting 12 as it is positioned for crimping on the hose 10 is provided.

Figure 15:
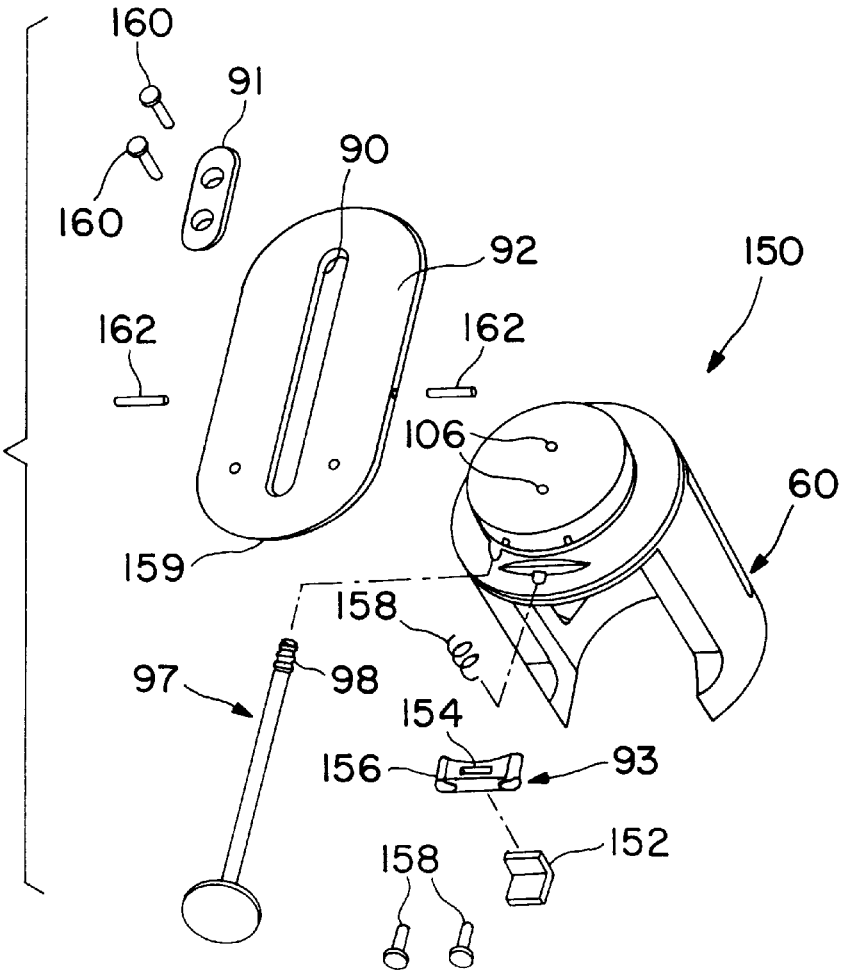
FIG. 15 is an exploded view of the pusher and attachments thereto which form a pusher assembly.

FIG. 15 is an exploded view showing the parts added to the pusher 60 to comprise what is in effect a pusher assembly 150. From FIG. 15, it is seen that he spring clip 93 includes an L-shaped bolt 152 which is mounted in a slot 154 in mounting bracket 156 that is retained on the pusher by screws 157. The L-shaped bolt is projected by a coil spring 158 to engage the front cage 159 of the plate 92. Furthermore, ti is seen that the slide flange 91 is attached to the pusher 16 by a pair of bolts 160 and that sliding of the pusher 60 in the slot 90 is facilitated by a pair of roller bearings 162.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. An apparatus for crimping a crimping collar on a hose fitting to a hose, comprising:

(a) a first frame mounted on a platform;

(b) a second frame having a lower end and an upper end and a longitudinal axis, the second frame being pivoted on the first frame;

(c) a base ring on the lower end of the second frame, the base ring having an internal camming surface coextensive with the longitudinal axis of the first frame;

(d) an annular crimping die assembly disposed within the internal camming surface of the base ring for crimping a collar inserted therein to a hose inserted therein when the crimping die assembly is pressed axially into the base ring;

(e) a hydraulic ram on the upper end of the second frame and in axial alignment with the crimping die assembly;

(f) a pusher disposed for axial alignment with the annular crimping die assembly, the pusher having a circular upper end attached to the ram and an arcuate lower end defined by a discontinuous surface for engaging the annular crimping die assembly, the discontinuous surface having a gap therein; and (g) the upper and lower ends of the pusher being joined by an arcuate wall in which the gap extends in an axial direction, the arcuate wall having three openings therethough which are spaced from one another and are spaced from the lower end with two of the openings being proximate the gap on opposite sides thereof and one of the openings being opposite the gap.

2. The apparatus of claim 1 wherein the gap has an arcuate extension which is greater than about 90° and less than about 180°.

3. The apparatus of claim 2 wherein the openings proximate the gap extend axially substantially to the upper end of the pusher and the third opening opposite the gap has an axial extent substantially less than the first and second openings.

4. The apparatus of claim 3 wherein wall converges from the upper end toward the lower end.

5. The apparatus of claim 4 wherein the pusher is made of cast iron.

6. The apparatus of claim 5 wherein the pusher is mounted on a slide fixed to the hydraulic ram for external movement between a first position out of axial alignment with the crimping die assembly to a second position in alignment with the crimping die assembly.

7. The assembly of claim 6 wherein the pusher has a handle attached thereto for pulling the pusher from the first position to the second position.

8. The assembly of claim 7 wherein the ram is mounted in a support which has a pair of lifting handles pivoted thereto for lifting the assembly.

9. The apparatus of claim 1 wherein the openings proximate the gap extend axially substantially to the upper end of the pusher and the third opening opposite the gap has an axial extent substantially less than the first and second openings.

10. The apparatus of claim 1 wherein wall converges from the upper end toward the lower end.

11. The apparatus of claim 1 wherein the pusher is made of cast iron.

12. The apparatus of claim 1 wherein the pusher is mounted on a slide fixed to the hydraulic ram for external movement between a first position out of axial alignment with the crimping die assembly to a second position in alignment with the crimping die assembly.

13. The assembly of claim 1 wherein the pusher has a handle attached thereto for pulling the pusher from the first position to the second position.

14. The assembly of claim 7 wherein the ram is mounted in a support which has a pair of lifting handles pivoted thereto for lifting the assembly.

* * * * *